United States Patent [19]

Boots

[11] Patent Number: 4,901,885

[45] Date of Patent: Feb. 20, 1990

[54] CONTAINER FOR FREE-FLOWING, FLUID, AND LIKE MATERIALS

[76] Inventor: Gerardus A. M. Boots, Boskriek 72, 5401 LP Uden, Netherlands

[21] Appl. No.: 143,630

[22] Filed: Jan. 13, 1988

[30] Foreign Application Priority Data

Jan. 13, 1987 [NL] Netherlands ..... 8700063

[51] Int. Cl.[4] ..... B65D 90/04

[52] U.S. Cl. ..... 220/402; 220/403; 220/71; 220/72.1

[58] Field of Search ..... 220/402, 403, 408, 71, 220/72.1; 383/104

[56] References Cited

U.S. PATENT DOCUMENTS

| | | | |
|---|---|---|---|
| 824,891 | 7/1906 | Van Hoesen | 220/71 |
| 827,751 | 8/1906 | Reis | 220/71 |
| 1,912,686 | 6/1933 | Brack | 220/469 |
| 3,101,839 | 8/1963 | Holman | 220/403 |
| 3,115,986 | 12/1963 | Groff | 220/403 |
| 3,949,901 | 4/1976 | Tokita | 220/71 |
| 4,102,376 | 7/1978 | Sharp | 220/403 |
| 4,115,909 | 9/1978 | Corella | 383/104 |
| 4,585,159 | 4/1986 | Travis | 220/71 |
| 4,658,989 | 4/1987 | Bonerlo | 220/403 |
| 4,729,505 | 3/1988 | Remaks et al. | 220/441 |
| 4,742,951 | 5/1988 | Kelly et al. | 220/441 |

FOREIGN PATENT DOCUMENTS

| | | | |
|---|---|---|---|
| 538727 | 6/1955 | Belgium . | |
| 703631 | 2/1965 | Canada | 220/441 |
| 0040476 | 11/1981 | European Pat. Off. . | |
| 2267255 | 11/1975 | France . | |
| 1467884 | 3/1977 | United Kingdom . | |
| 8605464 | 9/1986 | World Int. Prop. O. . | |

*Primary Examiner*—David T. Fidei

[57] ABSTRACT

A container for free-flowing, fluid and like materials, comprising a tubular outer envelope (1; 4; 7; 13; 17) that can be closed at both ends and a tubular inner member (2; 5; 8; 14; 18) which at at least four positions spaced about the circumference of the tubular outer envelope is connected to said outer envelope, said inner member having a length that is 30–100% of the height of the container. Said container further comprises stiffening means (3; 6; 10; 15; 19) extending throughout the entire height of the container, having a relatively high stiffness or tear resistance of their own, and extending substantially in contact with the inner member. Said stiffening means can be a tube (3; 6) telescoped within the inner member or substantially rigid stiffening members (10; 15; 19) inserted into pockets formed adjacent a joint (9) between the outer envelope and the inner member and extending lengthwise of the container.

7 Claims, 2 Drawing Sheets

CONTAINER FOR FREE-FLOWING, FLUID, AND LIKE MATERIALS

BACKGROUND OF THE INVENTION

This invention relates to a container for free-flowing, fluid and like materials, comprising a tubular outer envelope that can be closed at both ends and a tubular inner member which at at least four positions spaced about the circumference of the tubular outer envelope is connected to said outer envelope, said inner member having a length that is 30–100% of the height of the container.

A similar container is described in applicants copending U.S. "Pat. application Ser. No. 053,614 filed May 26, 1987."; There, the provision of the inner member that is connected to the outer envelope results in a container which is characterized by high dimensional stability and a very high stacking strength, even when relatively flexible and weak material is used, as, for example, paper. These particular properties are obtained by causing deformative and stacking forces to be absorbed by tensile forces generated in the inner member in the circumferential direction. When regularly stacked together and loaded, this container is very satisfactory. In the case of high to very high loads, problems may occur under particular conditions, for example, owing to the inner member becoming torn as a result of local diagonally directed forces, for example, from slightly warped or misaligned stacking, or from inertia forces during deceleration of a vehicle loaded with containers.

It is an object of the present invention to improve the strength of a container of the above kind still further, so that the container is sufficiently strong and dimensionally stable to resist extreme and non-uniform loading conditions as outlined above.

SUMMARY OF THE INVENTION

This is achieved, according to the present invention, by the provision of stiffening means extending throughout the entire height of the container, having a relatively high stiffness or tear resistance of their own, and extending substantially in contact with the inner member. The means thus provided are capable of absorbing any tear forces exerted on the inner member, by virtue of which, as far as its forces absorbing function in circumferential direction is concerned, the inner member can remain effectively operative fully or substantially fully without outward influences.

Depending on the load conditions to be expected, the material to be packaged, and the materials used for the container, the stiffening means can be realized in various ways. A simple but effective way of realizing the stiffening means, in case the material of the container per se is rather limp and weak, is provided by a further embodiment of the present invention, in which the stiffening means is a tube telescoped within the inner member.

If, for example, high stacking loads are expected, and the material to be packaged makes certain demands on the packaging material, such as that it should be nonporous or impermeable, which may indicate a flexible synthetic plastics or plastics-laminated material, it may be preferable, and in accordance with a further embodiment of the invention, that the tube is a one-piece sleeve made of a material of high tear strength and having an outer circumference fitting the inner member with clearance. The clearance is needed to prevent the sleeve, when expanded as result of the load, from exerting an additional load on the inner member rather than relieving it. In such an embodiment of the container, the stacking loads exerted on it are substantially absorbed by the sleeve, while the inner member provides for the dimensional stability of the container. In this way, a standard container of relatively limp and weak material can be rendered suitable for resisting high loads without collapsing, and also optimally ensures dimensional stability.

If the material to be packaged does not make any particular demands, as referred to above, on the packaging material, the tube may be made, for example, of a relatively rigid material, such as corrugated cardboard. In that case, in accordance with a further embodiment of the invention, the tube preferably consists of a sheet of material placed in the form of a tube, said material having a relatively high stiffness of its own and there being no connection, in the longitudinal direction of the tube, between the longitudinal edge regions of the sheet, extending in that direction. In this embodiment, the circumference of the tube automatically adapts itself to the inner circumference of the inner member. The inner member then provides for the dimensional stability and absorbing loads, while the tube ensures that no tear loads can be exerted on the inner member.

When very high loads are to be absorbed, it is preferable, and in accordance with a further embodiment of the invention, that, adjacent a joint between the outer envelope and the inner member, a pocket is formed extending lengthwise of the container, into which substantially rigid stiffening members have been inserted. Owing to these means, considerably larger compressive forces can be absorbed owing to the application of rigid stiffening members extending in the vertical direction only. This is possible, because the inner member provides for optimum dimensional stability, as a result of which the place of the stiffening members is accurately fixed, and their true vertical position is always ensured.

When in accordance with a further embodiment of the invention, a pocket is formed by two spaced connecting strips extending lengthwise of the container, for example, welded seams, between the outer envelope and the inner member, a pocket for, for example, a stiffening sheet material is realized in a simple manner. When a transparent packaging material is used, the stiffening sheet member can be used to advantage for the display of information about the material contained in the container.

Rod-shaped or bar-shaped stiffening members can be used when, in acccordance with a still further embodiment of the invention, a pocket is formed at a joint between the outer envelope and the inner member by connecting the outer envelope to the inner member, or the inner member to the outer envelope, along two parallel lines on one and one line on the other to form a loop in cross-section. The rigid stiffening members can be placed in position by inserting them into their pocket from the top of the container while it is still open. This may result in the rigid stiffening members bearing on the bottom of the outer envelope. When the outer envelope is made of a synthetic plastics material, and perforation of the plastics should be avoided, for example, in the packaging of liquids, it is preferable, and in accordance with a further embodiment of the invention that the pocket is closed by a cross-joint at at least two spaced positions, the outer envelope having at least one lateral hole in between two cross-joints to permit the passage of stiffening members. In this manner the stiffening members can be supported outside the outer envelope.

In case large transverse forces or forces at an angle to the horizontal are to be expected, or careless stacking or misalignment in stacks must be taken into account, it is advantageous, and in accordance with a further embodiment of the invention, that the stiffening means are slats or sticks interconnected at their top ends by a polygon composed of further slats, sticks or similar elements. In this manner, with a minimum of material, a maximum force transmission under the most widely different stacking and loading conditions can be effected, inasmuch as the polygon comprises members extending at an angle to the sidewalls of the container across the upper surface thereof.

BRIEF DESCRIPTION OF THE DRAWINGS

Some preferred embodiments of the invention will now be described, by way of example, with reference to the accompanying drawings, in which.

DESCRIPTION OF THE PREFERRED EMBODIMENTS

Figure 1:
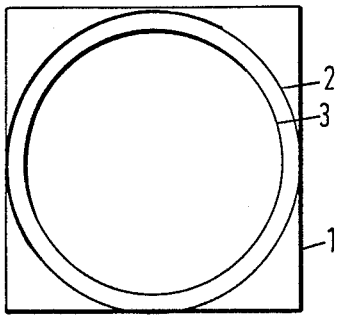
FIG. 1 shows a first embodiment in cross-section and top plan view.

The container shown in FIG. 1 comprises an outer envelope 1 having a substantially square cross-sectional configuration and an inner member 2, of substantially circular cross-sectional configuration, placed within it. The outer envelope 1 and the inner member 2 can be made of any suitable and desirable material. From considerations of cost, an inexpensive material will be preferred, such as paper, which in spite of being cheap, is suitable for many, if not all applications. It has been found that, even if the container is made of paper, due to the presence of the inner member, which when subject to tensile forces absorbs the majority of the forces exerted, a very high compressive load can be exerted on the container without collapse. If, however, forces are applied to the container at an angle to the vertical, this may lead to the inner member being torn, and hence to the collapse of the container. Under such loading conditions, the container can be used, although it is actually too weak, by placing a closed tube 3 of a tear-resistant material telescopically within the inner member 2. This may be, for example, a plastics-reinforced or laminated paper. The circumference of tube 3 should be so selected that, when loaded, tube 3 hardly, if at all, loads the inner member 2. For this purpose tube 3 in the unloaded condition should often be placeable within the inner member 2 with clearance.

Figure 2:
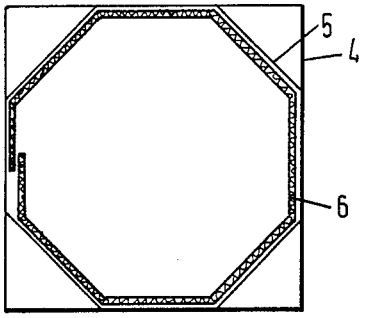
FIG. 2 shows a second embodiment in cross-section and top plan view.

If, in addition to a protection of the inner member from tearing, a certain dimensional stability of the container is desirable in its starting position, the embodiment illustrated in FIG. 2 can be selected. The container shown in FIG. 2 comprises an outer envelope 4 of square cross-sectional configuration and an inner member 5 having an octagonal circumference in cross-section. Placed in the inner member 5 is a tube 6 of a material having a relatively high stiffness of its own, such as, for example, corrugated cardboard. Tube 6 is made by placing a sheet of material in the form of an octagon, without interconnecting the overlapping longitudinal edge regions. When the container is filled, the material introduced will cause tube 6 to bed down on inner member 5. This latter, subject to tensile loads, will absorb the compressive loads exerted, whereby the inner member 5 will be freed of local tear loads by tube 6, which tear loads will be absorbed by tube 6 and converted into tensile forces in the inner member 5.

The shapes of the container illustrated in FIGS. 1 and 2 indicate that the material of which the outer envelope and the inner member have been made has a certain stiffness of its own. However, the container may alternatively be made of a material having hardly, if at all any stiffness of its own, such, for example, as a flexible synthetic plastics material or a fabric. Containers made of such materials are shown in FIGS. 3–6.

Figure 3:
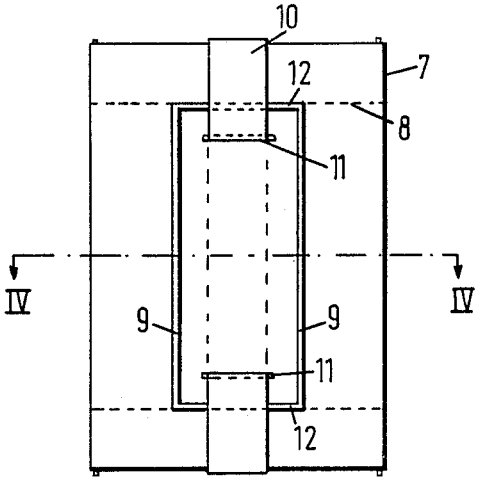
FIG. 3 shows a third embodiment in side-elevational view.
Figure 4:
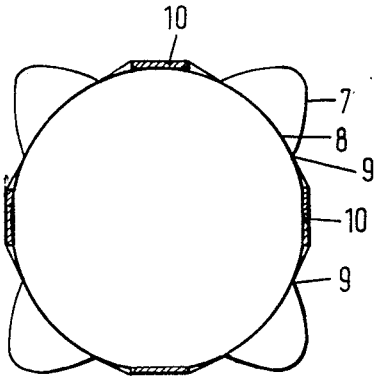
FIG. 4 shows a cross-sectional view, taken on the line IV—IV of FIG. 3.

The container shown in FIG. 3 and 4 comprises an outer envelope 7 and an inner member 8 having a height less than that of the outer envelope 7. At eight places spaced uniformly about the circumference, the outer envelope 7 and the inner member 8 are interconnected throughout the entire height of the latter, for example, by means of a sealed seam 9 when plastics materials are used which can be sealed together. Naturally, seam 9 may be made in any other manner. Owing to this construction, when the container is filled, the cross-sectional configuration shown in FIG. 4 results, whereby the outer envelope 7 and the inner member 8 are in substantial surface-to-surface contact with each other in four regions between respective pairs of seams 9, thereby forming a pocket into which rigid members 10 can be inserted to augment rigidity and stacking strength When members 10 are just inserted into the pockets, their bottom ends would bear on the bottom of the container. When this is undesirable, for example, by reason of the risk of leakage in case the container is used for packaging liquids, the solution shown in FIG. 3 can be selected. In the pockets between two seams 9, two lateral slots 11 are formed in the outer envelope 7, dimensioned so that a rigid member 10 can be inserted through them. To prevent leakage through these lateral slots, the outer envelope 7 and the inner member 8 are interconnected by means of two cross-seams 12. The rigid member 10 can be used further to display markings, directions for use and the like with regard to the material packaged. Furthermore the container thus produced can be bodily shifted into a cardboard packing and shipping box.

Figure 6:
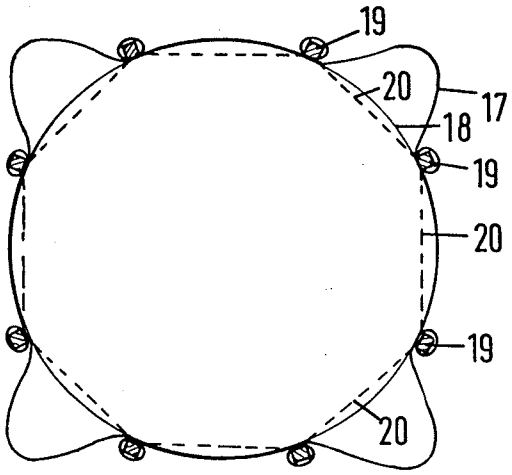
FIG. 6 shows, in cross-section and in top plan view, a fifth embodiment.
Figure 5:
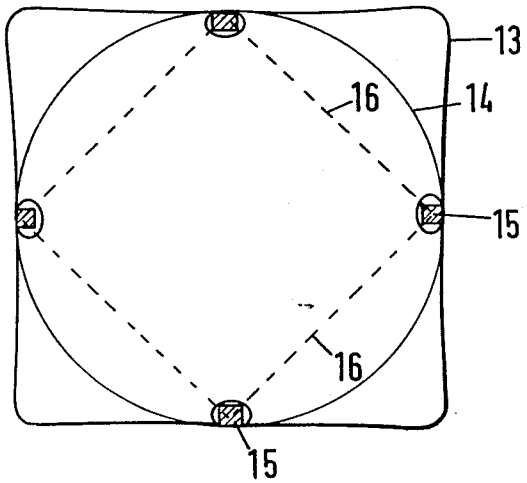
FIG. 5 shows, in cross-section and in top plan view, a fourth embodiment.

The container shown in FIG. 5 comprises an outer envelope 13 and an inner member 14 linearly connected to the outer envelope 13 at four positions regularly spaced about the circumference. To form pockets, the inner member 14 is connected to the outer circumference 13 along two spaced parallel lines, whereby a loop-shaped pocket is formed for a rigid bar or rod member 15. For further stiffening, and in particular for absorbing forces at an angle to the vertical, the four rigid members 15 may be interconnected at the top of the container by further rigid rod or stick members, as illustrated, by way of example, by dotted lines 16. Pockets are formed in the interior of the container by loop formation in the material of the inner member. When external pockets are preferred, these can be formed by loop formation in the material of the outer envelope, as shown in FIG. 6. The container shown in FIG. 6 comprises an outer envelope 17 and an inner member 18, linearly interconnected at eight positions regularly spaced about the circumference. At each joint, the outer envelope 17 is connected to the inner member 18 along two spaced parallel lines to form the loop. In each pocket thus formed, a rigid bar or stick member 19 is inserted, which members may be interconnected by similar members as indicated, by way of example, by dotted lines 20.

Naturally, many modifications and variants are possible without departing from the scope of the invention. Thus rigid elements 10 may used with a container as shown in FIG. 2, and a tube as shown in FIG. 1 or 2 may be used with a container illustrated in FIGS. 3–6, with or without the rigid members Furthermore, the tubes of FIGS. 1 and 2 are interchangeable with adaptation of configurations and dimensions. The configurations of the various elements shown in the Figures are given by way of example only. Both for the outer envelope and for the inner member, as well as for the added members, many other forms are feasible A similar remark should be made with regard to the materials of which the various parts can be made.

I claim:

1. A container for free-flowing, fluid and the like material, comprising:

a tubular outer envelope defining a wall of a predetermined height and circumference including at least four circumferentially spaced wall portions, said outer envelope being closeable at opposite ends transverse to the wall;

a tubular inner member having a circumference considerably smaller than that of the outer envelope and including at least four contact portions, the tubular inner member engaging, and being affixed to, the outer envelope only at said contact portions, said contact portions being of a width considerably less that the width of the respective wall portion, at said contact portions pockets being formed extending lengthwise of the outer envelope, the inner member having a height of about 30 to 100% of the height of the outer envelope; and stiffening means extending over the height of the outer envelope, having a relatively high stiffness or tear resistance, and being in contact with the inner member, said stiffening means being located in said pockets.

2. A container as claimed in claim 1, wherein each pocket is formed by two spaced connecting strips extending lengthwise of, and between, the outer envelope and the inner member.

3. A container according to claim 2, wherein the connecting strips are welded seams.

4. A container as claimed in claim 1, wherein said pockets are formed by a connection between the outer envelope and the inner member along two parallel lines, to form a loop in cross-section.

5. A container as claimed in claim 1, comprising cross-joints closing the pocket at at least two spaced positions, the outer envelope having at least one lateral hole between two cross-joints to permit passage therethrough of said stiffening means.

6. A container as claimed in claim 4, comprising cross-joints closing the pocket at at least two spaced positions, the outer envelope having at least one lateral hole between two cross-joints to permit passage therethrough of said stiffening means.

7. A container as claimed in any one of claims 1 to 6, wherein the stiffening means are slats interconnected at top ends thereof by a polygon composed of further slats.

* * * * *